United States Patent [19]

Nickow et al.

[11] Patent Number: 4,552,479

[45] Date of Patent: Nov. 12, 1985

[54] EASEL TYPE BINDER

[75] Inventors: Hy Nickow, Lincolnwood; Martin A. Nickow, Highland Park; Harold G. Rowlett, Chicago, all of Ill.

[73] Assignee: General Loose Leaf Bindery Co., Inc., Chicago, Ill.

[21] Appl. No.: 568,618

[22] Filed: Jan. 6, 1984

[51] Int. Cl.[4] ..... B42F 13/22; B42F 3/04; B42D 3/16

[52] U.S. Cl. ..... 402/74; 281/31; 281/33

[58] Field of Search ..... 281/31, 32, 33; 402/72, 402/74, 75, 76; 248/441.1

[56] References Cited

U.S. PATENT DOCUMENTS

| | | | |
|---|---|---|---|
| 2,883,209 | 4/1959 | Erickson | 281/33 |
| 3,121,576 | 2/1964 | Schade | 281/33 |
| 3,334,920 | 8/1967 | Orth | 281/33 |
| 4,015,863 | 4/1977 | Holum | 281/33 |
| 4,355,821 | 10/1982 | Crawford | 402/73 |
| 4,451,067 | 5/1984 | Williams | 281/31 |

FOREIGN PATENT DOCUMENTS

| | | | |
|---|---|---|---|
| 2439679 | 7/1980 | France | 402/72 |

*Primary Examiner*—Robert L. Spruill
*Assistant Examiner*—Paul M. Heyrana, Sr.
*Attorney, Agent, or Firm*—Hill, Van Santen, Steadman & Simpson

[57] ABSTRACT

An easel-type loose leaf binder including a front panel, a rear panel, and a central panel which is disposed between the other panels, with fold lines running longitudinally the full length of the front and rear panels adjacent the central panel. The fold lines permit the front and back panels to be folded into a binder closed position. A transversely extending fold line extends across the front, rear and central panels to permit an upper portion of the front and rear panels to be folded back into an easel providing position. A rigid frame containing a plurality of split ring mechanisms is provided in combination with a relatively flexible backing strip which is located behind the rigid frame. A portion of the backing strip above the transversely extending fold line is secured to said rigid frame alone, while a portion of the backing strip below the transversely extending fold line is secured to both the rigid frame and to the central panel. A flap-carrying member is secured to the central panel above the transversely extending fold line, and includes spaced flaps which are foldable longitudinally with respect to the flap-carrying member. Each flap has a locking tab formed therein which cooperates with spaced slots formed in the backing strip which receive the locking tabs in locked position so when the binder is in its easel-providing position, they rigidify the binder and improve its resistance to twist.

5 Claims, 6 Drawing Figures

EASEL TYPE BINDER

BACKGROUND OF THE INVENTION

1. Field of the Invention

The present invention is in the field of loose leaf binders and the like which can be folded into an easel-type structure in which the pages of the notebook are positioned at a convenient angle for viewing, the easel-type structure being mechanically rigid and resistant to twist.

2. Description of the Prior Art

There have been numerous suggestions in the prior art of loose leaf type binders which can be folded into an easel-type structure. For example, in U.S. Pat. No. 2,883,209 there is described a combined loose leaf binder and display device employing a series of panels in combination with a stiff wire which holds the loose leaf binder in the display position.

In U.S. Pat. No. 3,199,897 there is described another kind of easel-type device employing strips of spring steel as braces for holding the easel in its display position.

U.S. Pat. No. 3,224,792 is directed more specifically to a book structure which is capable of being supported in an upright or angular position by providing a leg or prop extending coextensively with the back of the book structure and hingedly secured thereto.

In U.S. Pat. No. 4,015,863 there is disclosed an easel-type binder utilizing a flap connected to a strip underlying the ring mechanism, the flap being foldable into a position in which it fits into a groove and holds the easel in its upright position.

SUMMARY OF THE INVENTION

The present invention provides an easel-type loose leaf binder which includes a front panel, a rear panel, and a central panel disposed between the other panels, with fold lines running longitudinally the full length of the front and rear panels adjacent the central panel to permit the front and back panels to be folded into a binder-closed position. For the purposes of this description, the "longitudinal direction" is taken to be parallel to the axis of the split rings, while the transverse direction is taken perpendicular to the longitudinal direction. The binder is provided with a transversely extending fold line which extends across the front, rear and central panels to permit an upper portion of each panel to be folded back into an easel providing position. The split ring mechanisms are, as in conventional practice, provided on a rigid frame and a relatively flexible backing strip is located behind this frame. Means are provided for securing a portion of the backing strip above the transversely extending fold line to the rigid frame alone, and additional securing means are provided for securing a portion of the backing strip below the transversely extending fold line to both the rigid frame and to the central panel.

A flap-carrying member is secured to the central panel above the transversely extending fold line, the flap-carrying member including spaced flaps which are foldable longitudinally with respect to the flap-carrying member, each flap having a locking tab formed therein. The backing strip has spaced slots therein proportioned to receive the locking tabs when the binder is in its easel providing position to thereby rigidify the binder in such position.

BRIEF DESCRIPTION OF THE DRAWINGS

A further description of the present invention will be made in conjunction with the attached sheets of drawings in which.

DESCRIPTION OF THE PREFERRED EMBODIMENTS

Figure 1:
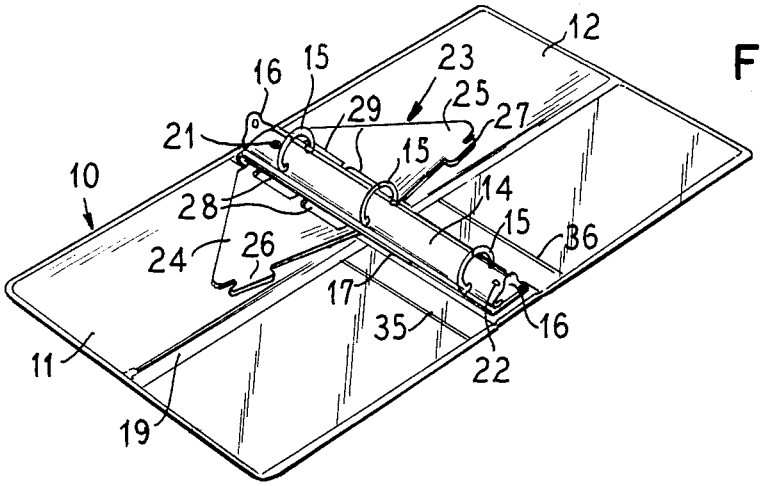
FIG. 1 is a view in perspective of the binder of the present invention in the flat, open position.
Figure 3:
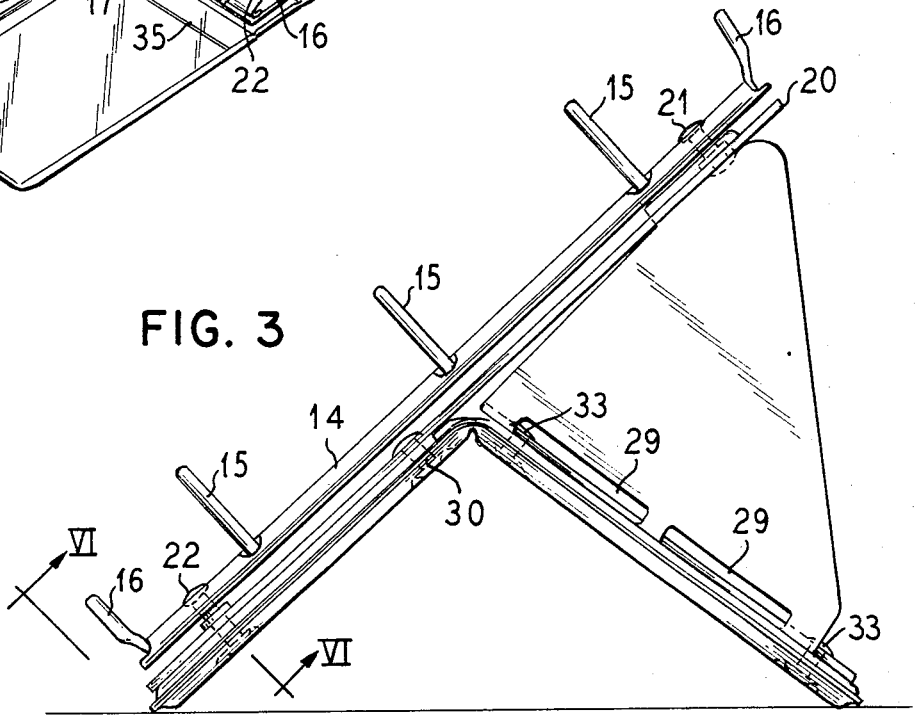
FIG. 3 is a side elevational view of the binder in the easel position.
Figure 6:
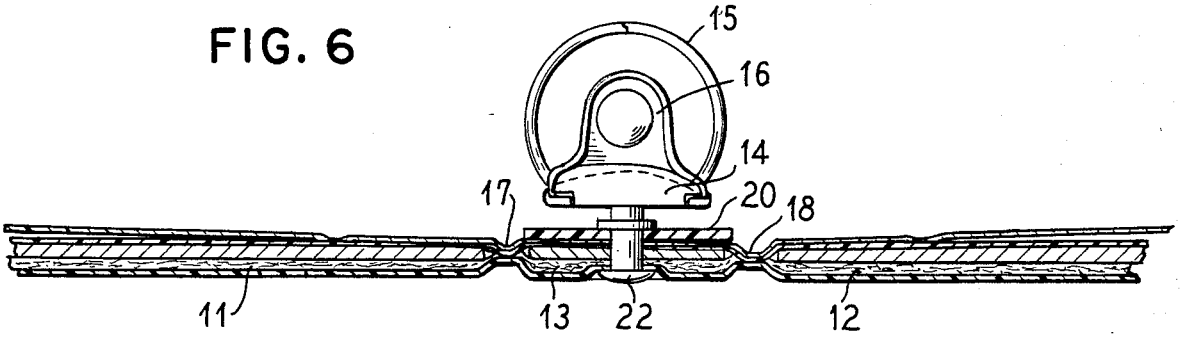
FIG. 6 is a cross-sectional view taken substantially along the line VI—VI of FIG. 3.

In FIG. 1, reference numeral 10 has been applied generally to an improved binder structure of the present invention which includes a front panel 11, a rear panel 12 and a central panel 13 (see FIG. 6). The panels can be composed of any suitable material such as thermoplastic resins such as polyethylene, polypropylene, polyvinyl acetatepolyvinyl copolymers, or the like, and they may be reinforced with paperboard or the like. The outer cover of the panels may, for decorative purposes, include a soft synthetic surface such as an artificial suede surface.

Disposed directly over the central panel 13 is a rigid frame 14 carrying three split ring mechanisms 15. Operators 16 sometimes known as triggers are provided at either end of the rigid frame structure 14 for opening and closing the split rings. The mechanical structure of the rings and their operation is conventional and does not form a part of the present invention.

Longitudinal fold lines 17 and 18 are provided adjacent the rigid frame 14 permitting the front and back panels 11 and 12 to be folded into a binder-closed position in keeping with usual practice.

Figure 2:
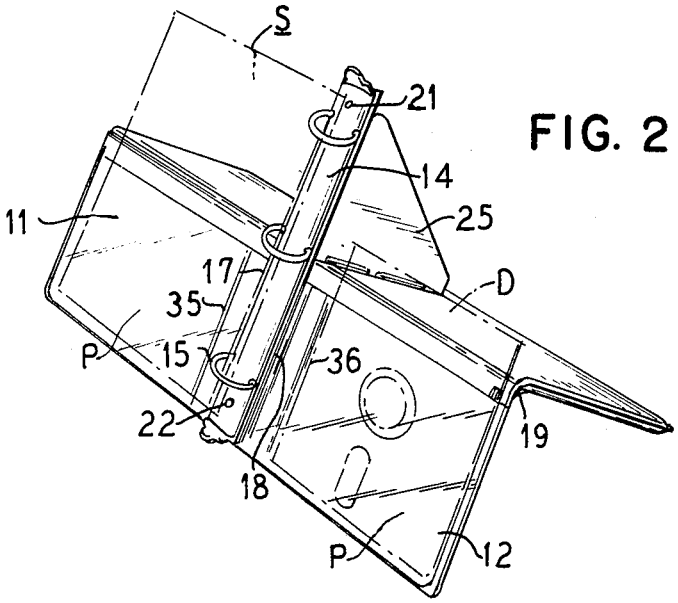
FIG. 2 is a view in perspective of the binder of the present invention in its easel providing position.

A medial fold line 19 extends transversely across the front panel 11, the central panel 13, and the rear panel 12 permitting the panels to be folded back as illustrated in FIG. 2 so that the upper portions of the panels form the back of the easel structure when so folded.

A relatively flexible backing strip 20 is located immediately behind the rigid frame 14 and is secured thereto by a first securing means which may be a rivet 21. Additional securing means such as a rivet 22 is provided below the transversely extending fold line 19 to secure a portion of the backing strip 20 to both the rigid frame 14 and the central panel 13, as best illustrated in FIG. 6 of the drawings. An additional rivet 30 secures the backing strip 20 solely to the central panel 13.

A flap-carrying member generally illustrated at numeral 23 in the drawings is secured to the central panel 13 by means of spaced rivets 33. This member can also be composed of a single sheet of relatively stiff plastic material such as polypropylene. As best illustrated in FIG. 1, the flap-carrying member 23 includes a pair of generally triangular-shaped flaps 24 and 25 each provided with a locking tab 26 and 27, respectively. To facilitate the folding of the flaps 24 and 25 relative to the rigid frame 14, pairs of slots 28 are provided in the flap 24 adjacent to the rigid frame, and additional pairs of slots 29 also extending longitudinally of the frame member are provided on the opposite side as illustrated in FIG. 1.

Figure 4:
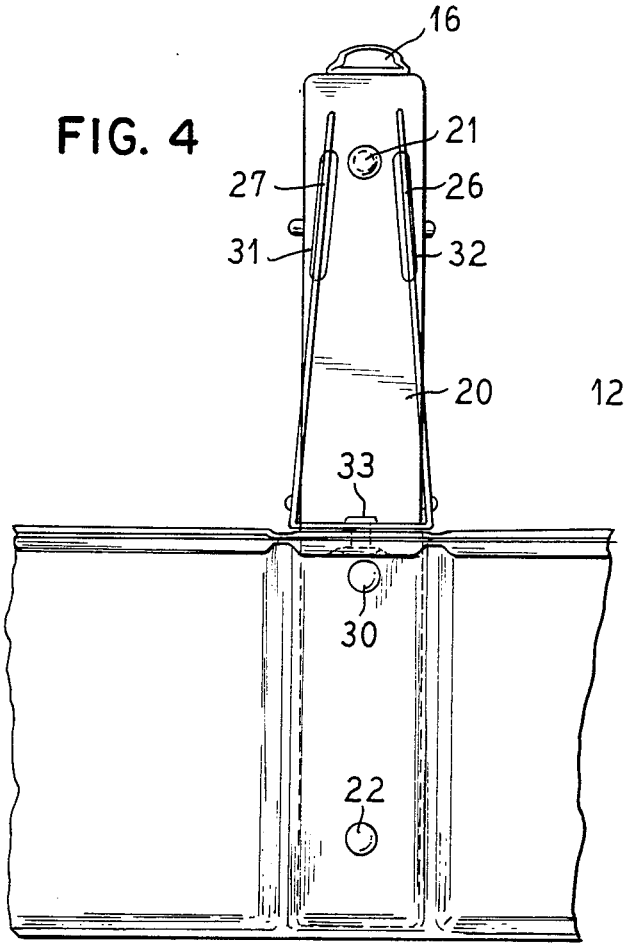
FIG. 4 is a fragmentary rear view of the binder assembly.
Figure 5:
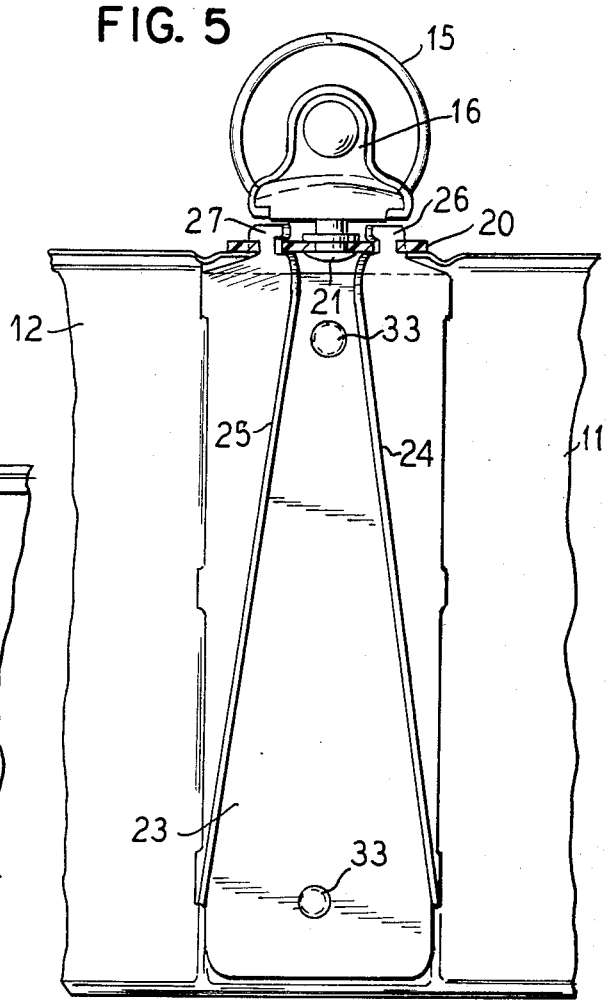
FIG. 5 is a fragmentary view in elevation of the binder showing the manner in which the locking tabs are received within the slots.

The flexible backing strip 20 has a pair of elongated slots 31 and 32 as best illustrated in FIG. 4. These slots are oriented upwardly and inwardly in converging relationship and serve to lock the tabs 26 and 27 therein when the binder is in the easel providing position. The presence of the two tabs 24 and 25 substantially rigidifies the structure and increases its resistance to twisting.

As best seen in FIG. 2, when the device is in the easel providing position a sheet of paper S is received in a position which is slightly beyond vertical to facilitate reading. The lower portion of the binder is provided with a pair of pockets P formed of a suitable transparent plastic material, the pockets being separated from the rigid frame 14 by longitudinally extending heat sealed line barriers 35 and 36, respectively. One of the pockets may be used, for example, for storing a floppy disk D as shown in FIG. 2. The heat sealed line barriers 35 and 36 prevent shifting movement of such disks toward the rigid frame member 14.

It should be evident that various modifications can be made to the described embodiments without departing from the scope of the present invention.

We claim as our invention:

1. An easel-type loose leaf binder comprising:

a front panel, a rear panel, a central panel disposed between said front panel and said rear panel, with fold lines running longitudinally the full length of said front and rear panels adjacent said central panel to permit said front and rear panels to be folded into a binder-closed position, together with a transversely extending fold line extending across said front, rear and central panels to permit an upper portion of each panel to be folded back into an easel providing position, a rigid frame, a plurality of split ring mechanisms in longitudinally spaced relation along said rigid frame, relatively flexible backing strip located behind said rigid frame, first securing means securing a portion of said backing strip above said transversely extending fold line to said rigid frame alone, second securing means securing a portion of said backing strip above said transversely extending fold line to both said rigid frame and said central panel, a flap-carrying member secured to said central panel above said transversely extending fold line, said flap-carrying member including spaced relatively rigid flaps foldable longitudinally with respect to said flap-carrying member, into upright positions, each flap having a locking tab formed therein, said backing strip having spaced slots therein proportioned to receive said locking tabs in spaced relation when said binder is in its easel providing position to thereby rigidify the binder in its easel providing position.

2. A binder according to claim 1 in which:

said flap-carrying member has longitudinally extending slots on either side of said rigid frame to facilitate the folding of said flaps.

3. A binder according to claim 1 wherein:

said spaced slots in said backing strip extend in upwardly and inwardly spaced relation.

4. A binder according to claim 1 which includes:

a first pocket secured to said front panel and a second pocket secured to said back panel, each pocket being separated from said rigid frame by a longitudinally extending heat sealed line barrier.

5. A binder according to claim 1 wherein said flap-carrying member extends from the upper end of said central panel to a line adjacent said transversely extending fold line.

* * * * *